US008020942B2

(12) United States Patent
Manici et al.

(10) Patent No.: US 8,020,942 B2
(45) Date of Patent: Sep. 20, 2011

(54) METHOD FOR THE MANUFACTURE OF COSMETIC PRODUCT APPLICATORS

(75) Inventors: Davide Manici, Beverate Di Brivio (IT); Alain Berhault, Paris (FR); Edward Brooke Crutchley, Turnbridge Wells (GB)

(73) Assignee: Albea Services, Gennevilliers (FR)

( * ) Notice: Subject to any disclaimer, the term of this patent is extended or adjusted under 35 U.S.C. 154(b) by 1057 days.

(21) Appl. No.: 11/772,991

(22) Filed: Jul. 3, 2007

(65) Prior Publication Data

US 2008/0023024 A1 Jan. 31, 2008

(30) Foreign Application Priority Data

Jul. 5, 2006 (FR) ..... 06 06112

(51) Int. Cl.
*A45D 40/26* (2006.01)
*A46B 11/00* (2006.01)

(52) U.S. Cl. ..... 300/21; 132/218; 132/320

(58) Field of Classification Search ..... 300/21; 132/320, 218; 401/129
See application file for complete search history.

(56) References Cited

U.S. PATENT DOCUMENTS 4,635,659 A 1/1987 Spatz
6,681,777 B2 * 1/2004 Gueret ..... 132/218
2005/0217691 A1 10/2005 Petit

FOREIGN PATENT DOCUMENTS

DE 3114748 12/1982

OTHER PUBLICATIONS

Search Report dated Feb. 9, 2007 in French Application No. 06 06112.

* cited by examiner

*Primary Examiner* — Randall Chin
(74) *Attorney, Agent, or Firm* — Banner & Witcoff, Ltd.

(57) ABSTRACT

A method for the manufacture of an applicator is described. The method is characterized in that: a) an application preform (5) is formed, b) at least one portion (50) of the preform (5) is transformed by machining, using a machining device (6) able to form in the preform (5) a plurality of typically transverse radial recesses (51) by removing material from the portion using a machining tool (60), thereby forming at least one machined component (7) fitted with a plurality of radial elements (70) of an application means (4), the machined component (7) being then, after cutting or possible lengthening, typically coupled to an axial rod (3).

34 Claims, 12 Drawing Sheets

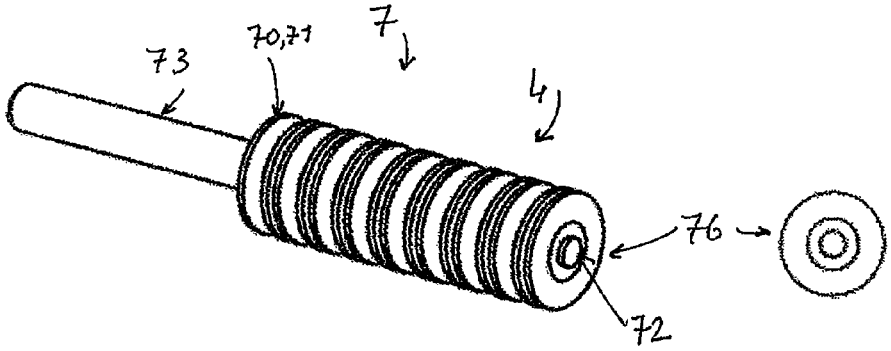
FIG. 1a
FIG. 1b
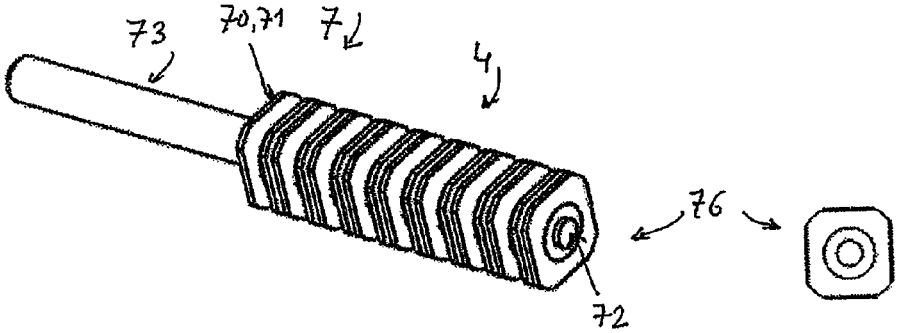
FIG. 1c
FIG. 1d
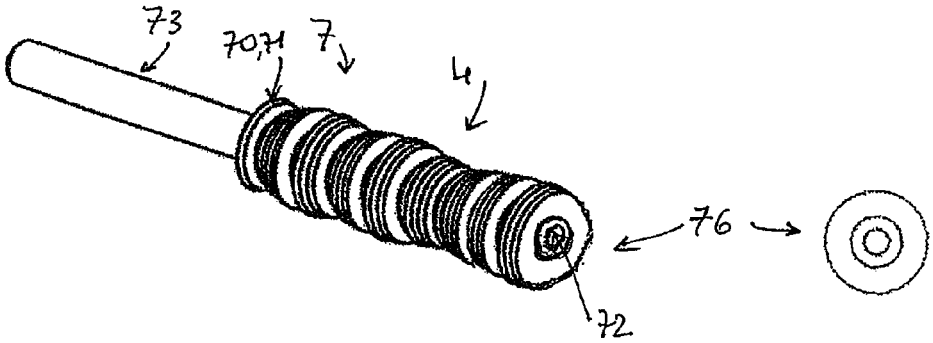
FIG. 1e
FIG. 1f

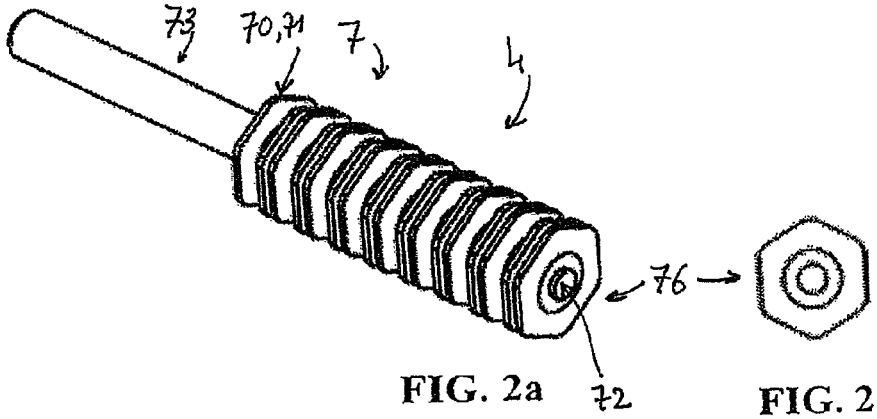
FIG. 2a
FIG. 2b
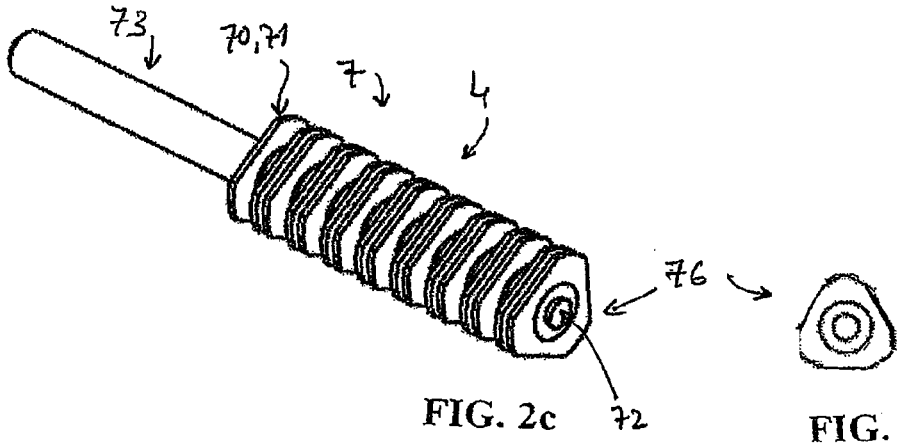
FIG. 2c
FIG. 2d
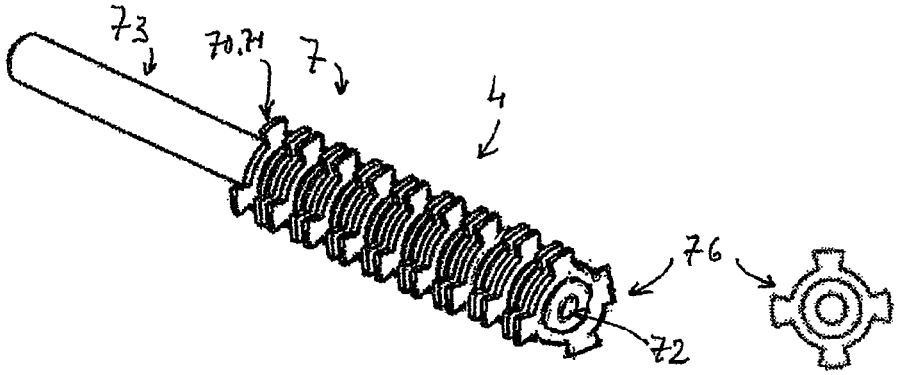
FIG. 2e
FIG. 2f

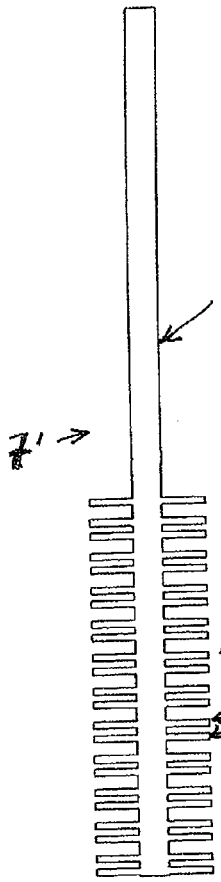
FIG. 10a
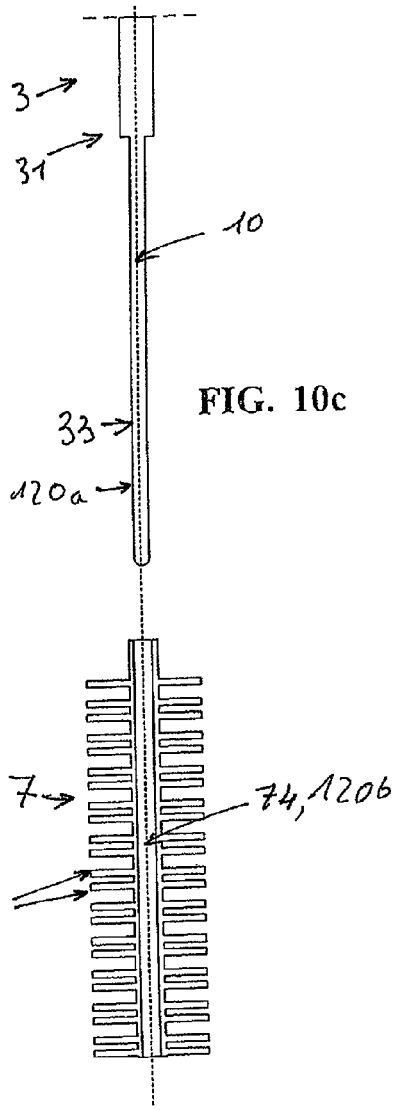
FIG. 10c
FIG. 10b
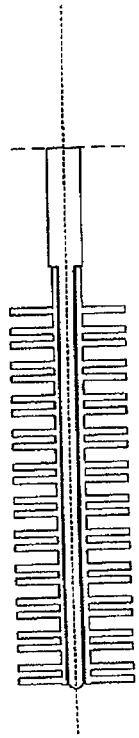
FIG. 10d

METHOD FOR THE MANUFACTURE OF COSMETIC PRODUCT APPLICATORS

FIELD OF THE INVENTION

The invention relates to the field of cosmetic product applicators, typically cosmetic products for making up the eyes, such as mascaras for example.

PRIOR ART

There are already a great number of known mascara applicators.

These applicators, intended to engage with a container forming a tank for the mascara, typically include:

a) a cap intended to close said container and to act as a means for gripping said applicator, b) an axial rod, c) and a brush, said rod being integral with said cap at one of its ends, and with said brush at the other of its ends, said brush including a metal twist fastening a plurality of hairs.

As far as said brush is concerned, a very great number of brush modes are already known.

Thus, brushes are already known as described in French patents FR 2 505 633, FR 2 605 505, FR 2 607, 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 693, FR 2 774 269, FR 2 796 531, FR 2 796 532, FR 2 800 586.

Brushes are also known as described in American patents U.S. Pat. Nos. 4,733,425, 4,861,179, 5,357,987, 5,595,198, 6,241,411, 6,427,700.

Mascara applicators are also known formed by a component moulded out of a plastic material, as described for example in the patent FR 2 868 264 filed by the applicant.

Problems Posed

Although applicators forming a component moulded out of a plastic material may constitute a beneficial alternative to the use of conventional brushes, they do nonetheless pose a number of problems.

Indeed:

- on the one hand, injection moulding requires the highly expensive manufacture of injection moulds, which can only be justified when the potential for large production runs is guaranteed,
- on the other hand, the launch time for applicators of this kind is very long given in particular the time it takes to manufacture the moulds,
- additionally, it is difficult to obtain a moulded component of great precision and of great finesse, given the limitations specific to moulding technology,
- finally, the manufacture of applicators by moulding presents a number of problems of a technical nature, namely:
  - the difficulty in controlling the final dimensions of the moulded component given shrinkage or potential distortion on cooling,
  - the visible presence of a mark corresponding to the line of closure of the different parts of the mould,
  - the presence of internal residual constraints in the moulded components, constraints which will lead to the subsequent weakening and/or distortion of the moulded components.

The method for the manufacture of applicators according to the invention sets out to resolve these problems.

DESCRIPTION OF THE INVENTION

In the method for the manufacture of an applicator with an axial direction and including a manual gripping means, an axial rod, and an application means including a plurality of radial elements, said gripping means being integral with said axial rod at its so-called upper part via a so-called first assembly means, said application means being integral with said axial rod at its so-called lower part via a so-called second assembly means, the constituent components of said applicator, and particularly said application means, are formed or supplied, and are assembled.

This method is characterised in that:

a) an application means preform is formed, b) at least one portion of said preform is transformed by machining, using a machining device able to form in said preform a plurality of typically transverse radial recesses by removing material from said portion using a machining tool, so as to form a plurality of radial recesses thereby forming at least one machined part fitted with said plurality of radial elements of said application means, said machined component being then, after cutting or possible lengthening, typically coupled to said axial rod.

This method allows the problems posed to be resolved.

DESCRIPTION OF THE FIGURES

All the figures relate to the invention.

FIGS. 1*a* to 2*f* relate to various modes of machined components (7) forming said application means (4).

Figures 3A, 3B, 3C:
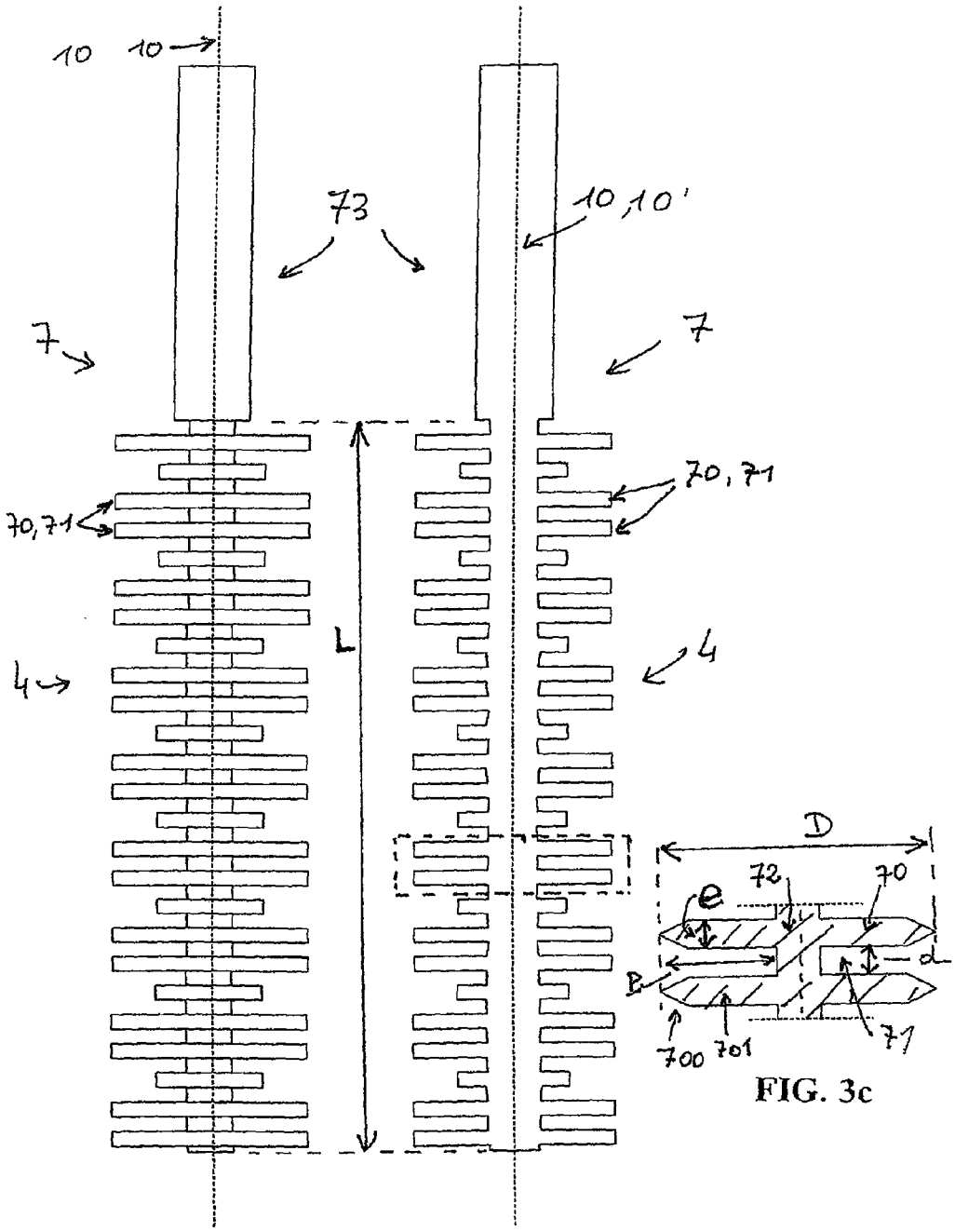

In these modes, the machined components (7) include a plurality of radial elements (70) forming a plurality of parallel transverse elements with a central core (72), and an axial part (73) forming a male element (120, 120*a*) of said second means (12) for coupling the axial rod (3) to the application means (4).

FIGS. 1*a*, 1*c*, 1*e*, 2*a*, 2*c* and 2*e* are perspective views of the machined components (7).

FIGS. 1*b*, 1*d*, 1*f*, 2*b*, 2*d* and 2*f* are corresponding front views of the lower end (76) of the machined components (7).

In FIGS. 1*a* and 1*b*, all the parallel radial elements (70) are elements of circular cross-section of the same diameter.

In FIGS. 1*c* and 1*d*, all the parallel radial elements (70) are elements of the same square cross-section with rounded corners.

In FIGS. 1*e* and 1*f*, all the parallel radial elements (70) are elements of circular cross-section of variable diameter.

In FIGS. 2*a* and 2*b*, all the parallel radial elements (70) are elements of hexagonal cross-section.

In FIGS. 2*c* and 2*d*, all the parallel radial elements (70) are elements of triangular cross-section with rounded corners.

In FIGS. 2*e* and 2*f*, all the parallel radial elements (70) are elements of cruciform cross-section.

FIG. 3*a* is an enlarged side view of a machined component (7) similar to that in FIG. 1*a*. This component includes in particular 17 parallel radial elements (70) of large diameter grouped in twos except as regards the first element adjacent to said axial part.

FIG. 3*b* is an axial cross-section view along said axial direction (10, 10') of the machined component in FIG. 3*a*.

FIGS. 3*a* and 3*b* define an application means profile (4).

FIG. 3*c* is an enlarged view of the part in FIG. 3*b* surrounded by a dotted line rectangle, wherein said parallel radial elements (70), which are separated by a hollowed out part (71), include a streamlined peripheral part (700).

FIGS. 4*a* to 4*i* relate to the machining of a preform (5) using a machining tool (60).

Figures 4A, 4B, 4C, 4D, 4E:
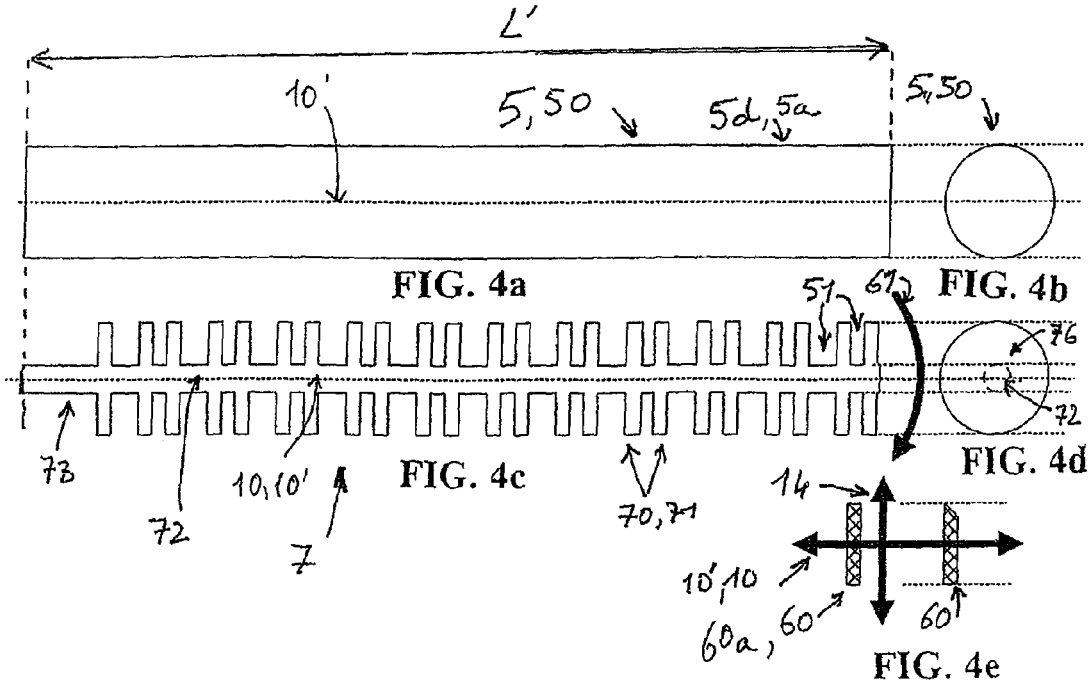

FIGS. 4*a* and 4*b* relate to a preform portion (50), with FIG. 4*a* being a side view, and FIG. 4*b* being a transverse cross-section in a plane perpendicular to the axial direction (10') of said preform portion (50).

FIG. 4*c* is an axial cross-section view of the machined component (7) obtained from the preform portion (50) in FIGS. 4*a* and 4*b*.

FIG. 4*d* is a view of the lower end (76) of the machined component (7) in FIG. 4*c*. In FIGS. 4*c* and 4*d*, an arrow indicates that the preform portion (50) and the corresponding machined component (7) were in rotation upon themselves.

In FIG. 4*e*, a machining tool (60) has been shown, according to a view from above on the left and according to a view from the side or in cross-section on the right. This tool (60) is a so called transverse tool (60) able to be displaced along a transverse direction (14) represented by an arrow, so as to form a radial recess (51), and along the axial direction (10, 10') to form the plurality of radial recesses (51) over the whole of the required length of said preform portion (50).

Figures 4F, 4G, 4H, 4I:
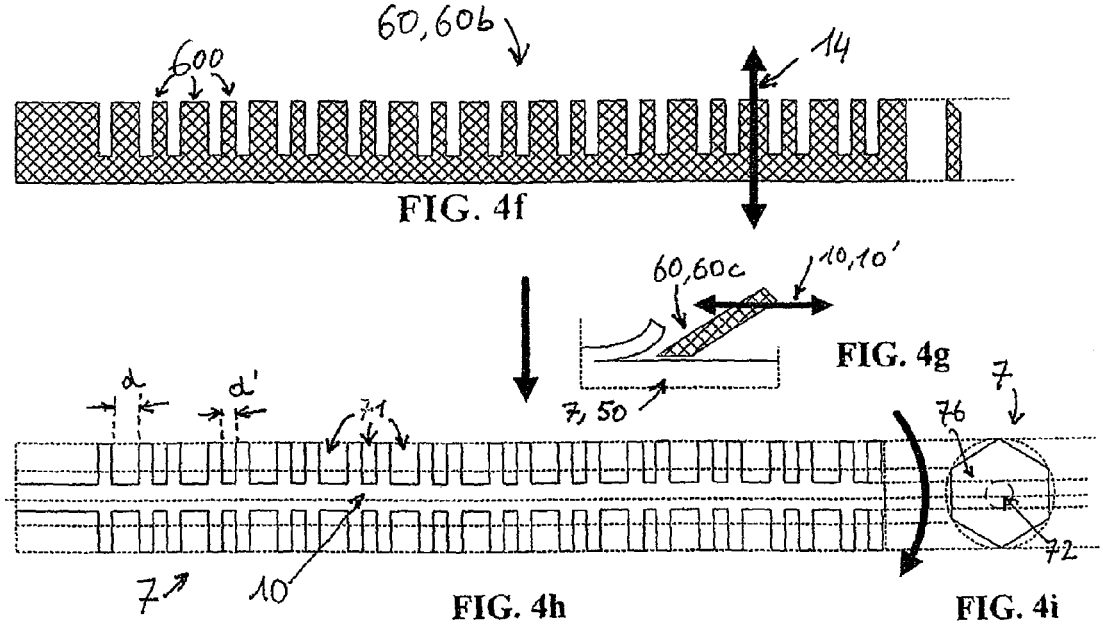

FIG. 4*f*, similar to FIG. 4*e*, shows a so-called fixed tool (60, 60*b*) allowing said plurality of radial recesses (51) to be formed at one and the same time.

FIG. 4*g* shows diagrammatically a so-called axial tool (60, 60*c*) in the process of removing material from said preform portion (50), or possibly from said machined component (7), by a relative displacement along the axial direction (10, 10').

FIGS. 4*h* and 4*i* are similar to FIGS. 4*c* and 4*d*, but the parallel transverse elements (71) are of hexagonal cross-section in the case of FIGS. 4*c* and 4*d*.

FIGS. 5*a* to 5*d* show modes of the method according to the invention.

Figures 5A, 5B, 5C, 5D:
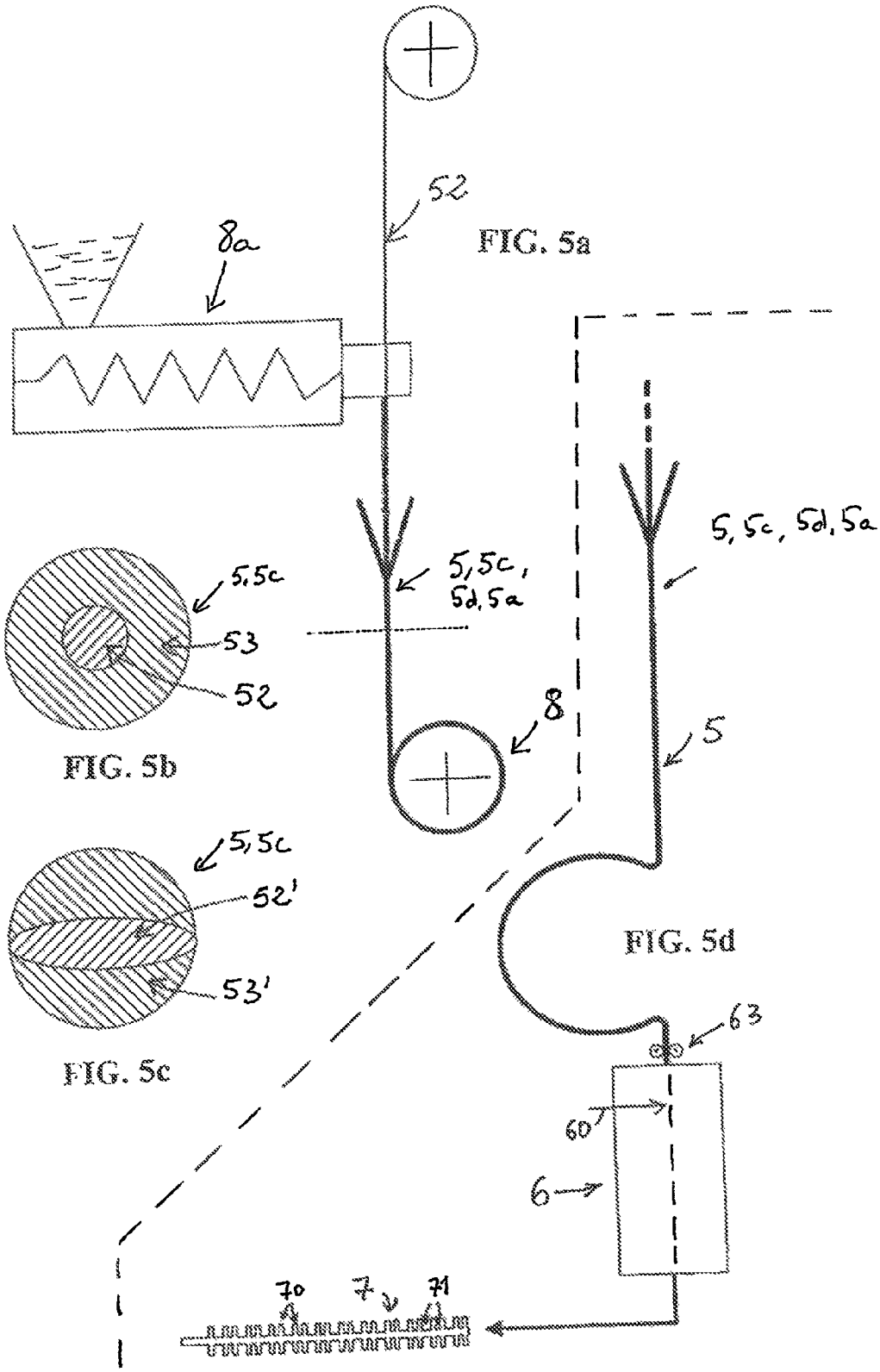

FIG. 5*a* shows in diagram form and a method wherein a core (52) of a typically metal wire is coated, using an extruder (8*a*), with an outer sheath forming an outer layer (53), so as to obtain a section (5*c*) equipped with at least two distinct materials, this section being stored in a form of a coil (8), said coil being intended to be used on a pick-up basis and to supply a machining device (6).

FIG. 5*b* shows a transverse cross-section of the section (5*c*) with two materials (52, 53).

FIG. 5*c*, similar to FIG. 5*b*, shows a variant of the section (5*c*) with two materials (52', 53');

FIG. 5*d* shows in diagrammatic form a method wherein the machining device (6) is continuously supplied with section (5*c*) as described in FIG. 5*a*, said section (5*c*) being introduced step by step into the machining device (6) using a motor (63) and a profile loop (5*c*) forming an accumulator, said device (6) delivering at output the machined components (7).

Figures 6A, 6B:
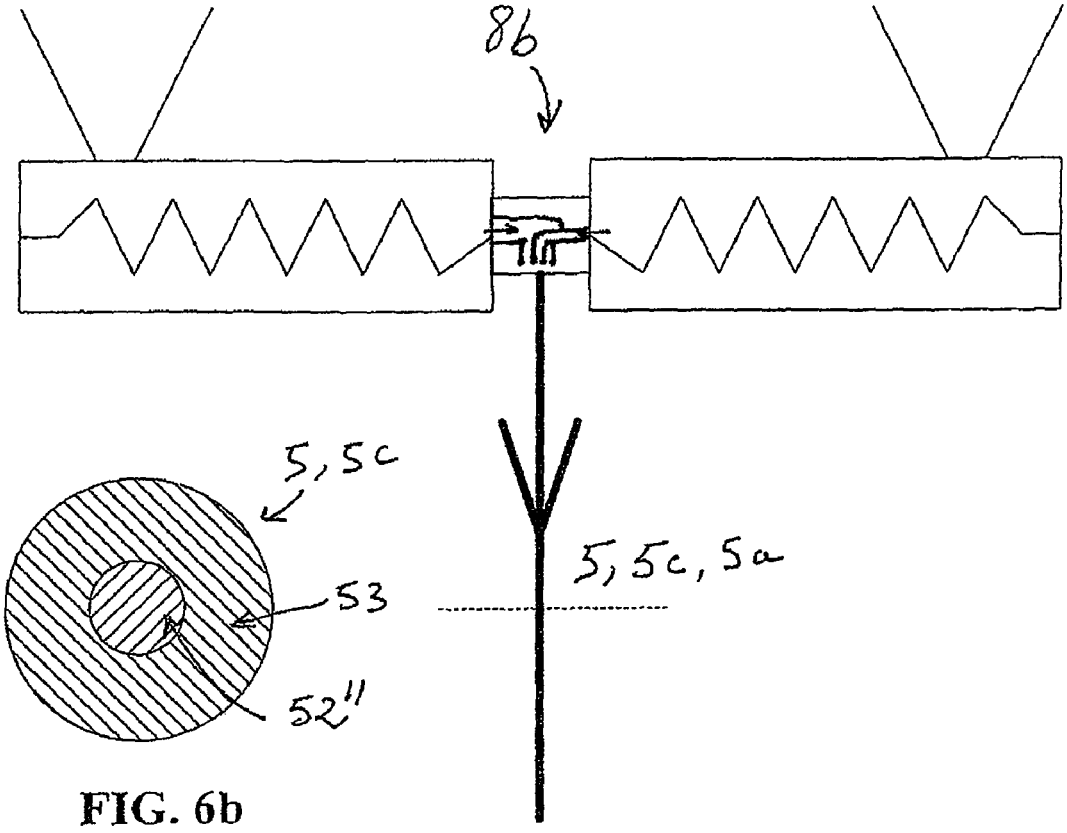

FIGS. 6*a* and 6*b* are similar to FIGS. 5*a* and 5*b*, and are distinguished from them in that the extruder (8*a*) has been replaced by a co-extruder (8*b*) in such a way that the section core is an extruded core (52") instead of being a metal wire.

Figure 7A:
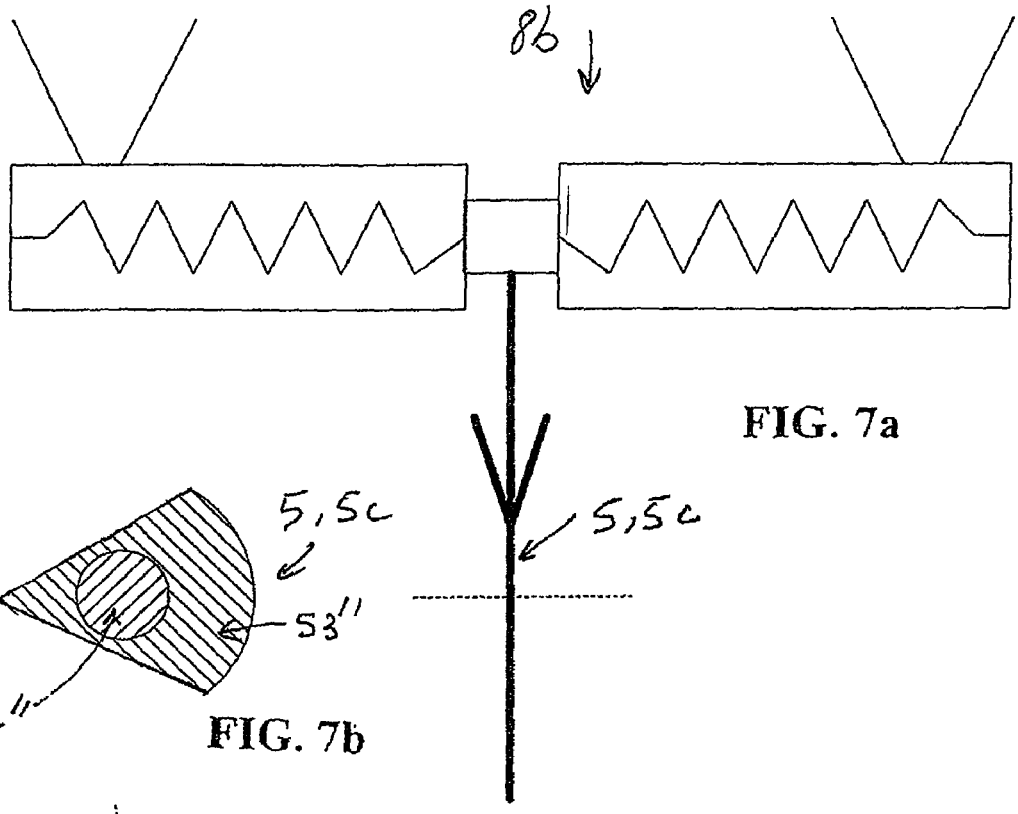
Figure 7B:
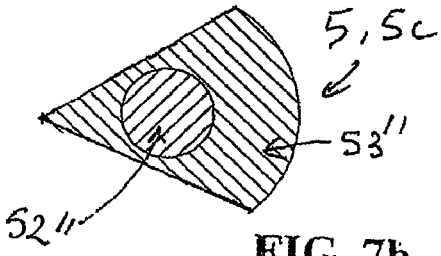
Figure 7C:
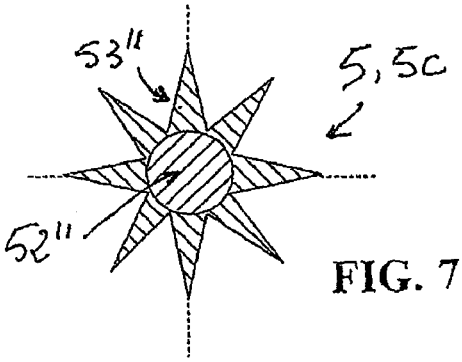

FIG. 7*a*, identical to FIG. 6*a*, shows a co-extruder equipped with a shape die, so as to obtain a section (5, 5*c*) of non-circular cross-section, as shown by way of example in FIGS. 7*b* and 7*c*.

In FIG. 7*b*, the transverse cross-section forms an angular sector able to allow a comb to be formed on one side of the machined component (7).

In FIG. 7*c*, the transverse cross-section forms a star.

Figures 8A, 8B, 8C:
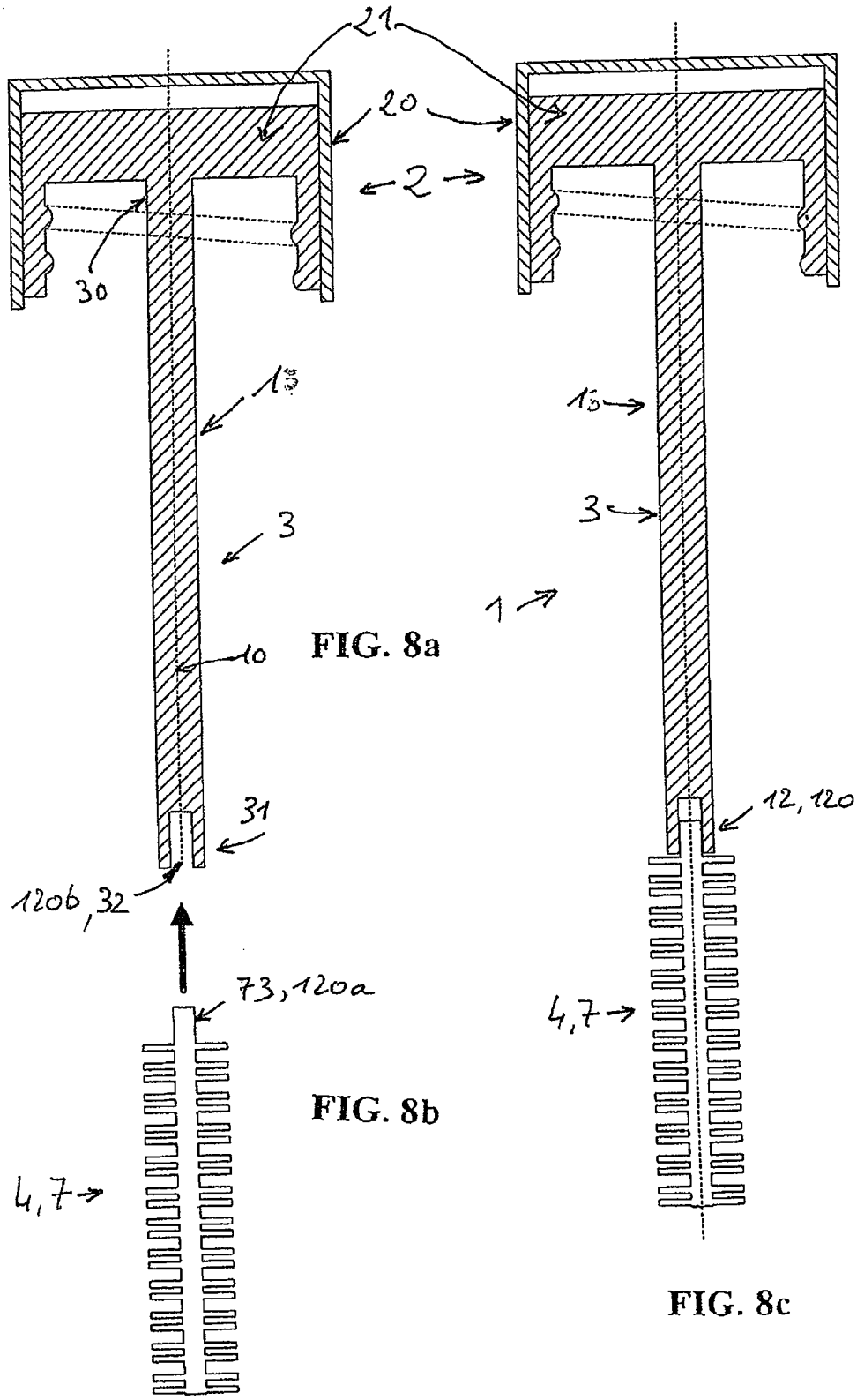

FIGS. 8*a* to 8*c* are axial cross-sections relating to the application (1) and its constituent components.

FIG. 8*a* shows a unit formed by the manual gripping means (2) and said axial rod (3), the manual gripping means including an outer shell (20) fastened to an inner insert (21), said insert (21) including an inner threaded skirt and a head fastened to the axial rod (3) forming a component moulded in a single piece (13).

FIG. 8*b* shows a machined component (7) forming said application means (4) intended to be coupled to the axial rod (3).

FIG. 8*c* shows the applicator (1) obtained after assembly, typically by force fitting, of the axial part (73) of the machined component (7) into the blind hole (32) of the axial rod (3) at its lower part (31).

Figure 9A:
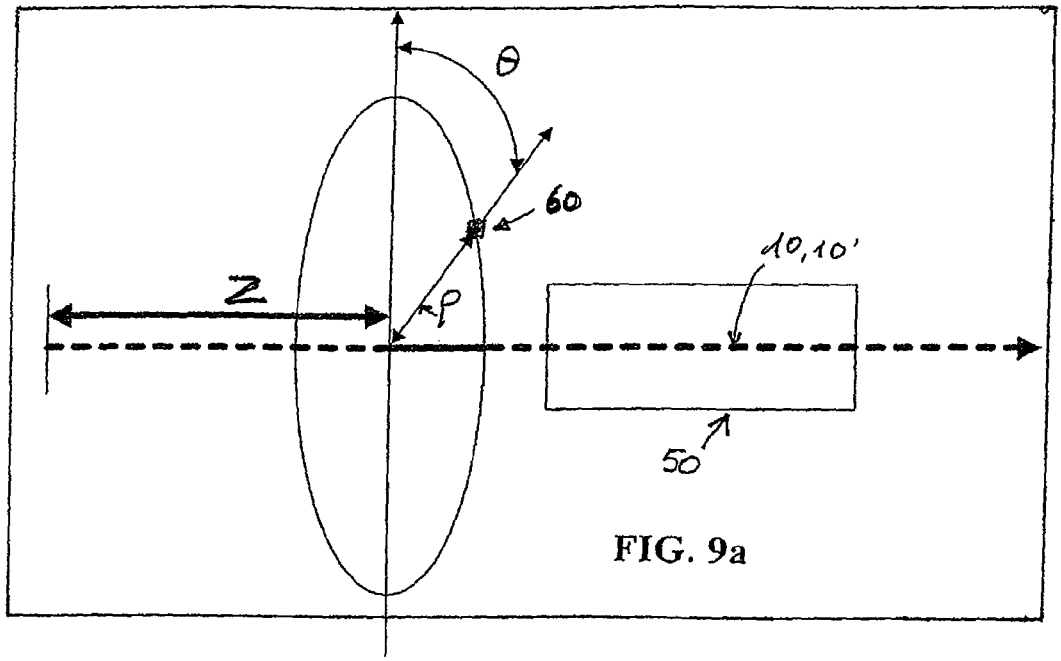

FIG. 9*a* shows the relative positioning of the machining tool (60) relative to the portion (50) defined by a system of co-ordinates giving the axial position Z along the axial direction (10, 10'), the angular position θ and the lateral gap ρ relative to the central axis.

Figure 9B:
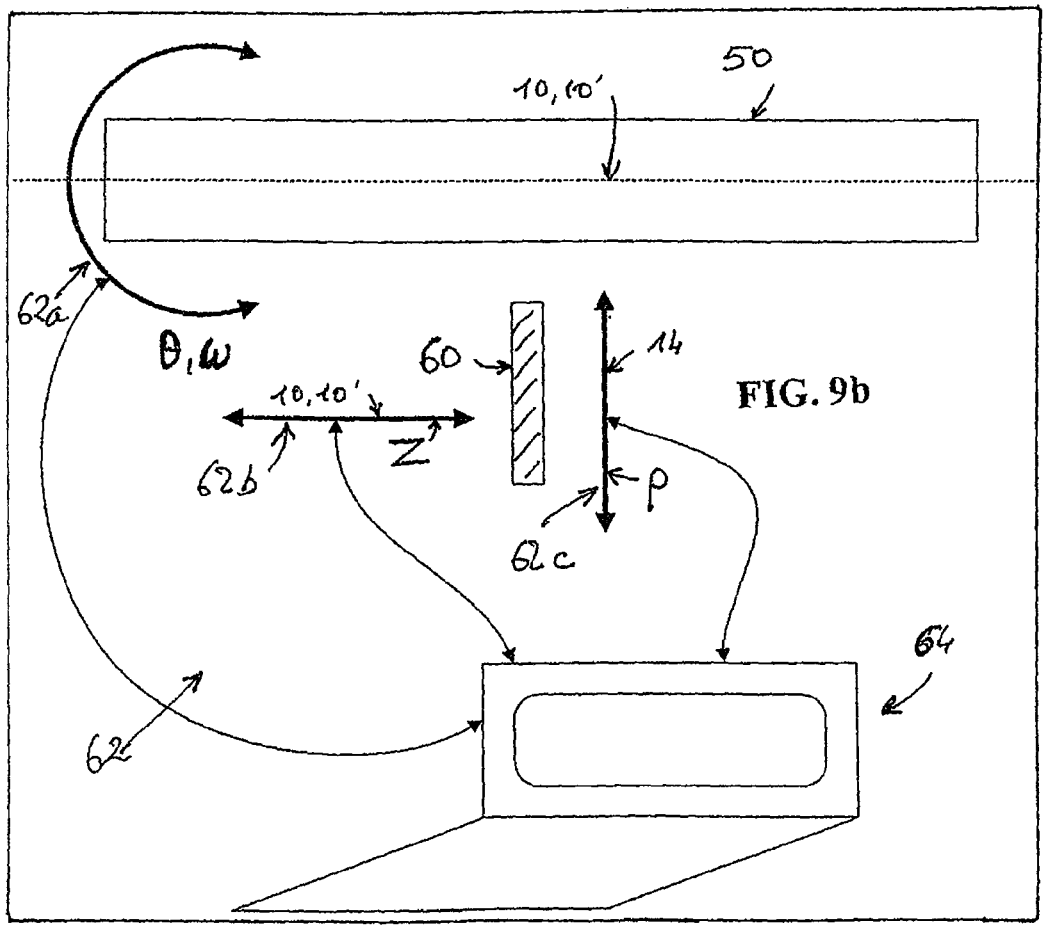

FIG. 9*b* shows in diagrammatic form the control of a machining tool (60), the relative displacement of this tool (60) being controlled by a computer (64) in consideration of the stored program relative to a given mode of the machined component (7). The computer activates a means for the relative displacement (62) of this tool (60) by setting, as a function of the time, its Z, ρ, θ, by means typically of three displacement means:

a means (62*a*) of relative angular displacement as θ a means (62*b*) of relative axial displacement as Z, a means (62*c*) of lateral relative separation as ρ.

FIGS. 10*a* to 10*d* are axial cross-sections which show other modes of the invention.

FIG. 10*a* shows a machined component cast in one piece (7') including, apart from the application means (4), the axial rod (3).

FIGS. 10*b* to 10*d* show the case where the machined component (7) includes an axial cavity (74), as shown in FIG. 10*b*, and where said axial rod (3) includes at its lower part (31) an axial projection (33), as shown in FIG. 10*c*, in such a way that the axial projection (33) forming said male element (120*a*) of said second assembly means (12) engages with the axial cavity (74) forming said female element (120*b*), as shown in FIG. 10*d*.

Figures 11A, 11B:
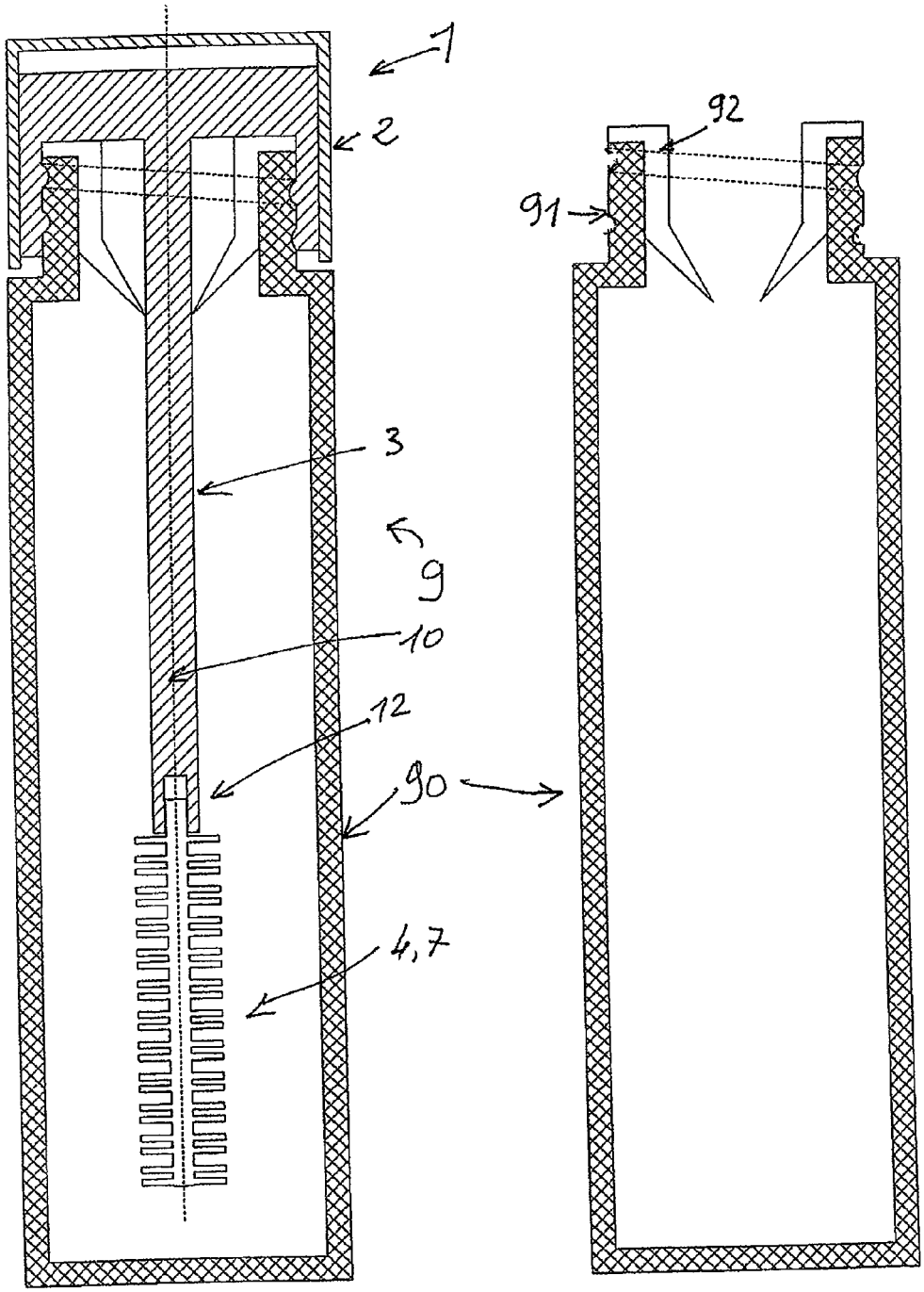

FIG. 11*a* is an axial cross-section showing a dispenser (9) equipped with an applicator (1) according to the invention, said applicator (1) being screwed to the body (90).

FIG. 11*b* shows the body (90) equipped with a neck (91) to which is anchored a wringer (92).

Figure 12A:
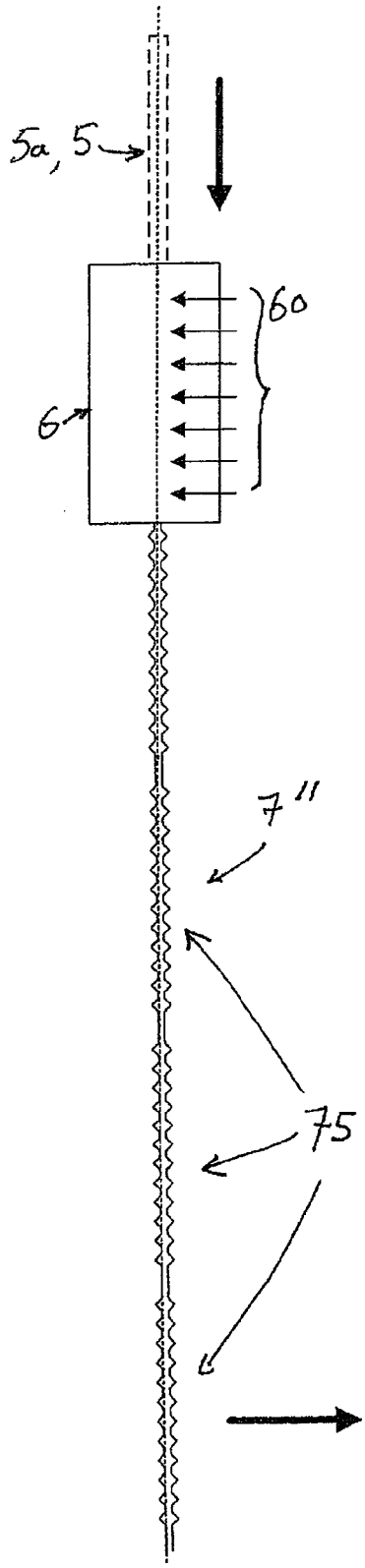
Figure 12B:
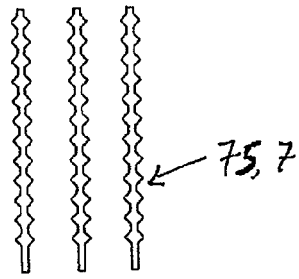

FIGS. 12*a* and 12*b* show in diagrammatic form another mode of the method according to the invention.

FIG. 12*a* shows the machining device (6) supplied upstream with section (5*a*) as preform (5) and delivering downstream a long machined product (7").

FIG. 12*b* shows this long machined product (7") cut up to give a plurality of elementary machined components (75).

DETAILED DESCRIPTION OF THE INVENTION

According to one mode of the invention, said preform (5) may be formed by injection or co-injection of at least one plastic material.

Said preform (5) may also be formed by over-moulding an outer layer (53) of plastic material over a metal core (52).

If these cases, a device is used that allows a plurality of preforms (5) to be obtained simultaneously.

As shown in FIGS. 5*a*, 6*a* and 7*a*, said preform (5) may be formed by extrusion or co-extrusion of a section (5*a*) of constant transverse profile, and cutting said section (5*a*) into at least one linear portion (50) of said section (5*a*).

According to the invention, said section (5*a*) may be a single material section (5*b*) in a material selected from a metal or a plastic material.

As shown in FIGS. 5*b*, 5*c* and 6*b*, said section (5*a*) may be a section (5*c*) including at least two distinct materials.

The two materials may be two plastic materials, typically with a first so-called rigid plastic material forming a central part or core (52) of said section, and a second so-called flexible plastic material forming a peripheral part (53) of said section.

Said two materials may include a plastic material and a metal.

Said section (5*a*, 5*b* 5*c*) may have a diameter or a larger transverse dimension D of between 1.5 mm and 10 mm, preferably between 2.5 mm and 5 mm.

Said section (5*a*, 5*b*, 5*c*) may be a so-called full section (5*d*), of external cross-section selected from round, oval, polygonal cross-sections.

As shown in FIG. 7*c*, said section (5*a*, 5*b*, 5*c*) may be a so-called grooved section (5*e*) including at least one axial groove (54) and of external cross-section including at least one concave part, and typically n axial grooves and concave parts, with n being between 2 and 12.

It is possible to have a section of non-circular cross-section as shown in FIG. 7*b*.

Said section (5*a*, 5*b*, 5*c*, 5*d*) may be a so-called hollow section (5*f*), like the one which has been used to make the machined component (7) in FIGS. 10*b* and 10*c*.

As shown in FIG. 4*c*, said machining device (6) may include a means (61) for putting said linear portion (50) into relative rotation relative to said tool (60), said tool (60) including at least one so-called transverse tool (60*a*) in a fixed axial position so as to form on said linear portion, by a relative rotation of said linear portion and of said transverse tool, at least one typically transverse radial recess (51) and, preferably, a plurality of transverse radial recesses (51) thereby forming said application means (4) equipped with a pre-set axial profile. In FIG. 4*c*, the rotation means (61) has been shown in the diagram by an arrow.

As shown in FIG. 4*f*, relative to said rotated linear portion, said tool (60) may be a tool (60*b*) fixed in said axial direction (10') of said linear portion, but mobile in a transverse direction perpendicular to said axial direction (10').

As shown in FIG. 4*g*, said machining device (6) may include a so-called axial tool (60*c*) of relative axial displacement relative to said linear portion (50), so as to form on said linear portion (50), by a relative axial displacement of said linear portion and of said axial tool, at least one helical or axial recess depending on whether said relative axial displacement is or is not accompanied by a relative rotation of said linear portion (50) relative to said axial tool (60*c*).

As shown in FIGS. 9*a* and 9*b*, said machining device (6) may include a means (62) for the relative displacement of a least one machining tool (60), relative to said portion (50) considered as a fixed marker, said tool having a relative position marked by a system of co-ordinates, typically with an axial marker Z, a radial marker ρ and an angular marker θ, in such a way that, since said displacement means of said tool is typically computer-controlled, said tool (60) is displaced and activated, as a function of a pre-established program, to form said radial recesses (51).

As shown in FIG. 4*f*, said tool (60) may include a plurality of machining elements (600) so as to form said plurality of radial recesses (51) simultaneously.

According to the invention, said metal forming all or part of said preform (5) may be selected from: an iron alloy, typically a stainless steel, a copper alloy, typically a brass, an aluminium alloy.

Said plastic material forming all part of said preform (5) may be selected typically from: LDPE, HDPE, POM, PTFE, PA, PP.

As shown in FIGS. 3*a* and 3*b*, said application means (4) of said machined component (7) has an axial length L of between 15 mm and 35 mm and a diameter or larger transverse dimension D of between 3 mm and 10 mm.

As shown in FIG. 3*c*, said radial elements (70) of said machined component (7) may be spaced apart or separated from each other by a distance d of between 0.2 mm and 1 mm.

Said radial elements (70) may have a thickness e of between 0.2 mm and 1 mm.

Said radial recesses (51) may have a radial depth P of between 0.1.D and up to 0.8.D, and preferably between 0.3.D and up to 0.6.D.

According to the invention, said plurality of radial elements (70) may include a plurality of N parallel transverse elements (71), orientated typically perpendicular to said axial direction (10, 10'), with N being between 6 and 35.

As shown in FIGS. 1*b*, 1*d*, 1*f*, 2*b*, 2*d* and 2*f*, said radial elements (70) may have a cross-section in a transverse plane perpendicular to said axial direction (10, 10') selected from among: a circular, oval, polygonal, typically square or triangular cross-section, with possibly rounded angles, a symmetrical cross-section relative to said axial direction.

As shown in FIG. 3*c*, said radial elements (70) may be integral with a central core (72), said radial elements (70) typically including a streamlined peripheral part (700) and an intermediate part (701) having a typically constant thickness e.

Typically, said machined component (7) includes, apart from said application means (4), an element (120) of the second assembly means (12), so as to be able to couple said machined component (7) to said axial rod (3).

As shown for example in FIGS. 1*a*, 1*c*, 1*e*, said machined component (7) may include an axial part (73) forming a male element (120*a*) of said second assembly means (12), said male element (120*a*) being intended to engage with a blind hole (32) formed at the lower part (31) of said axial rod (3), said blind hole (32) forming a female element (120*b*) of said second assembly means (12), said male (120*a*) and female (120*b*) elements being assembled typically by being snapped on axially or bonded or welded typically with ultrasounds, or by being forced fitted.

As shown in FIG. 10*b*, said machined component (7) may include an axial cavity (74) forming a female element (120*b*) of said second assembly means (12), said female element (120*b*) being intended to engage with an axial projection (33) formed at said lower part (31) of said axial rod (3), said axial projection (33) forming said male element (120*a*).

As shown in FIG. 10*a*, said machined component (7) may be a machined component (7') including, apart from said application means (4), said axial rod (3).

As shown in FIG. 12*a*, said machined component (7) may form a long machined component (7") including a plurality of n elementary machined components (75), with n being typically between 2 and 20, said elementary machined components (75), after cutting said long machined product (7"), forming said machined components (7).

According to one mode of the method according to the invention:

a) said preform (5) may first be formed continuously, said preform being stored in the form of a coil (8) or a roll of a long product of great length, b) said preform (5) may be machined, on a pick-up basis, said machining device (6) being supplied upstream with said coil or said roll (8).

According to another mode shown in FIGS. 5*d*, and 12*a*, said preform (5) may be formed and said machining device (6) may be supplied with said preform (5) so formed, said preform (5) supplying said machining device (6) either continuously or step by step.

According to the invention, said preform (5) and/or said machined component (7) are subject to a surface treatment, so as to obtain special effects, particularly special visual effects.

Said plastic material may include a filler, typically a mineral filler, with a content weighting of between 0.1% and 20%, so as to facilitate the machining of said plastic material.

As shown in FIGS. 8*a* and 8*c*, said manual gripping means (2) may include an outer shell (20) and an inner insert (21) integral with said axial rod (3), typically by being snapped on axially, forming said first assembly means (11), said shell (20) and said insert (21) being integral in rotation, said insert being coupled to said shell typically by being snapped on axially.

As shown in these same figures, said rod (3) and said inner insert (21) may form a component cast in one piece (13), typically a component moulded out of a plastic material.

Another purpose of the invention is constituted by a cosmetic product dispenser (9) typically of mascara, including an applicator (1) according to the invention and a body (90) including a tank for said cosmetic product, equipped with a neck (91) able to engage by screwing/unscrewing with said manual gripping means (2) of said applicator (1), said neck (91) typically being integral with a wringer (92) able to wring said application means (4) each time said applicator (1) is withdrawn from said body (90). A dispenser of this kind (9) has been shown in FIG. 11*a*.

EMBODIMENT EXAMPLES

The figures are examples of embodiments of modes of the method and modes of machined components (7) obtained by the method.

Machined components (7) have therefore been manufactured with diverse geometric shapes, as shown in the figures, both as regards the transverse cross-section and the longitudinal profile.

As regards the transverse cross-section, machined components (7) have been manufactured that have the transverse cross-sections shown in the FIGS. 1*b*, 1*d*, 1*f*, 2*b*, 2*d*, and 2*f*.

Machined components (7) have also been manufactured that have the cross sections of the section (5) shown in FIGS. 7*b* and 7*c*.

As regards the longitudinal profile, machined components (7) have been manufactured whereof the radial elements (70) have one and the same cross-section over the whole length L of the part of the machined component (7) forming said application means, as shown in FIGS. 1*a*, 1*c*, 2*a*, 2*c*, 2*e*, 4*c* and 4*h*.

By way of example, the profile includes a succession of radial elements (70) having between them an alternate succession of gaps d and d' with d>d', as shown in FIG. 4*h*.

As regards the longitudinal profile, machined components (7) have been manufactured whereof the radial elements (70) have a variable cross-section over the whole length L of the part of the machined component (7) forming said application means, as shown in FIG. 1*e*.

As regards the longitudinal profile, machined components (7) have also been manufactured whereof the radial elements (70) have a combination of two different cross-sections, as shown in FIGS. 3*a* and 3*b*.

As regards the method used, it includes on the one hand the formation of a preform (5).

The preforms (5) have been formed or supplied in the form of a section (5*a*) constituted of a single material, as shown in FIGS. 4*a* and 4*b*. Tests have been carried out using cylindrical reeds, made of metal such as aluminium, or, by extrusion, of a plastic material such as PP.

Preforms (5) have also be formed in the form of sections (5*c*) including two distinct materials, as shown in FIGS. 5*b*, 5*c*, 6*b*, 7*b* and 7*c*.

In this case, the material taken for the core (52) was either a metal or a so-called first relatively rigid plastic material such as PP, and the material taken to form the outer layer (53) was a so-called second plastic material less rigid than said first plastic material, possibly an elastomer.

When the core is metal, the device shown in diagrammatic form in FIG. 5*a* was used.

When the core is made of plastic material, the device shown in diagram in FIGS. 6*a* and 7*a* was used.

The method then includes the machining of said preform (5) and typically the machining of a portion (50) of said preform using a machining device (6) including typically:

- at least one machining tool (60),
- a means (61) for putting said portion (50) into rotation,
- a means for the typically automatic displacement of the tool (60), so as to obtain said machined component (7) with particularly the required axial profile.

At a practical level, several procedures were adopted:

- on the one hand, the machining device (6) was supplied with portions (50) of preform (5), and these portions (50) obtained by cutting off pieces of a section (5*a*) were machined, as shown in FIGS. 4*a* to 4*i*,
- on the other hand, the machining device (6) was also supplied directly with section (5*a*) as shown in FIG. 5*b*,
- finally, a procedure was also adopted as shown in FIG. 12*a* to form a long machined product (7") which was then cut off in pieces to obtain a plurality of machined components (7, 75).

The machining device (6) used was automated, as shown in diagrammatic form in FIG. 9*b*.

More often than not, the portion (50) was made to turn at great speed, with a relatively high speed ω, and in the case where the machining tool (60) is a simple tool with a width d', this tool is therefore on the one hand, for a given value of Z corresponding to an axial position, displaced along the transverse direction so as to vary the radial distance ρ thereby controlling the depth P of the radial recesses (71), then the value of Z is increased to pass to an adjacent position of Z until the machining tool (60) has been displaced over the whole length L'>L, L' being the axial length of said portion (50).

However, the orientation of said portion (50) may also be made to vary by an angle θ=f(t), while varying Z and possibly ρ for example in order to form helical recesses.

ADVANTAGES OF THE INVENTION

The invention has considerable advantages. Indeed, it allows a potentially infinite number of applicator variants to be manufactured without having to manufacture a specific mould for each variant beforehand.

In this way, on the one hand, it is possible to manufacture a very large number of samples of different geometry for the purposes of tests and selection, and to do so typically by introducing the specific profiles of the required applicators into a computer memory.

A coupling of diverse materials and diverse profiles can therefore be tested.

On the other hand, particularly in the case of small to medium scale production runs, an economic calculation shows that there is a threshold for which manufacture by moulding is not cost-effective given the investment in moulds. In this case, it is more advantageous to proceed by machining.

Furthermore, as the trend is towards production runs which are all the shorter the more significant the renewal rate, the present invention is an advantageous solution in response to this new trend.

LIST OF REFERENCE NUMBERS

Applicator 1
- Axial direction 10, 10'
- First assembly means of 2 and 3 11
- Second assembly means of 3 and 4 or 7 12
  - Element of 12 120
  - Male element of 12 120*a*
  - Female element of 12 120*b*
- Component moulded in one piece=21+3 13

Transverse direction perpendicular to 10, 10' 14

Manual gripping means 2
- Outer shell 20
- Inner insert 21

Axial rod 3
- Upper part 30
- Lower part 31
- Blind hole forming 120*b* 32
- Axial projection forming 120*a* 33

Application means 4
- Radial element of 4 40

Preform of 4 5

Section 5*a*

Single material section 5*b*

Section with at least two materials 5*c*

Full section 5*d*

Grooved section 5*e*

Hollow section 5*f*
- Portion of 5, 5*a* 50
- Radial recesses 51
- Section core 52,52',52"
- Outer layer 53,53',53"
- Axial groove 54

Machining device 6
- Machining tool 60
  - Machining element of 60 600
- Transverse tool 60*a*
- Fixed tool 60*b*
- Axial tool 60*c*
- Means of rotating 5 61
- Means of displacing 60 as Z, ρ and θ 62
- Means of relative angular displacement as θ 62*a*
- Means of relative angular displacement as Z 62*b*
- Means of relative angular displacement as ρ 62*c*
- Stepper motor 63
- Computer 64

Machined component 7

Machined component in a single piece 3+4 7'

Long machined product 7"
- Radial element 70
  - Peripheral part 700
  - Intermediate part 701
- Parallel transverse elements 71
- Central core 72
- Axial part 73
- Axial cavity 74
- Elementary machined part of 7" 75
- Lower end of 7 76

Coil, roll 8

Extruder 8*a*

Co-extruder 8*b*

Dispenser 9
- Body—tank 90
- Neck 91
- Wringer 92

What is claimed is:

1. Method for the manufacture of an applicator with an axial direction and including a manual gripping means, an axial rod, and an application means including a plurality of radial elements, said gripping means being integral with said axial rod at an upper part via a first assembly means, said application means being integral with said axial rod at a lower part via a second assembly means, characterized in that:

a) an application means preform is formed, b) at least one portion of said preform is transformed by machining, using a machining device able to form in said preform a plurality of transverse radial elements by removing material from said portion via a machining tool, so as to form a plurality of radial recesses thereby forming at least one machined component equipped with said plurality of radial elements of said application means, said machined component being then, after cutting, coupled to said axial rod, wherein said preform is formed by extrusion or co-extrusion of a section of constant transverse profile, and cutting said section into at least one linear portion of said section.

2. Method according to claim 1, wherein said preform is formed by injection or co-injection of at least one plastic material.

3. Method according to claim 2, wherein said plastic material forming all part of said preform is selected from: LDPE, HDPE, POM, PTFE, PA, and PP.

4. Method according to claim 2, wherein said plastic material includes a filler with a content weighting of between 0.1% and 20%, so as to facilitate the machining of said plastic material.

5. Method according to claim 1, wherein said preform is formed by over-moulding an outer layer of plastic material over a metal core.

6. Method according to of claim 5, wherein said metal forming all or part of said preform is selected from: an iron alloy, a copper alloy, and an aluminum alloy.

7. Method according to claim 1, wherein said section is a single material section in a material selected from a metal or a plastic material.

8. Method according to claim 1, wherein said section is a section including at least two distinct materials.

9. Method according to claim 8, wherein the two materials are two plastic materials, with a first rigid plastic material forming a central part or core of said section, and a second flexible plastic material forming a peripheral part of said section.

10. Method according to claim 8, wherein said two materials include a plastic material and a metal.

11. Method according to claim 1, wherein said section has a diameter or a larger transverse dimension of between 1.5 mm and 10 mm, and preferably between 2.5 mm and 5 mm.

12. Method according to claim 1, wherein said section is a full section, of external cross-section selected from round, oval, and polygonal cross-sections.

13. Method according to claim 12, wherein said section is a hollow section.

14. Method according to claim 1, wherein said section is a grooved section including n axial grooves and concave parts, with n being between 1 and 12.

15. Method according to claim 1,wherein said machining device includes a means for putting said linear portion into relative rotation relative to said tool, said tool including at least one transverse tool in a fixed axial position so as to form on said linear portion, by a relative rotation of said linear portion, and of said transverse tool, at least one transverse radial recess and, preferably, a plurality of transverse radial recesses thereby forming said application means equipped with a pre-set axial profile.

16. Method according to claim 15, wherein, relative to said to rotated linear portion, said tool is a tool fixed in said axial direction of said linear portion, but mobile in a transverse direction perpendicular to said axial direction.

17. Method according to claim 1, wherein said machining device includes an axial tool of relative axial displacement relative to said linear portion, so as to form on said linear portion, by a relative axial displacement of said linear portion and of said axial tool, at least one helical or axial recess depending on whether said relative axial displacement is or is not accompanied by a relative rotation of said linear portion relative to said axial tool.

18. Method according to claim 1, wherein said tool includes a plurality of machining elements so as to form said plurality of radial recesses simultaneously.

19. Method according to claim 1, wherein said application means of said machined component has axial length L of between 15 mm and 35 mm and a diameter or larger transverse dimension of between 3 mm and 10 mm.

20. Method according to claim 1, wherein said radial elements of said machined component are spaced apart or separated from each other by a distance d of between 0.2 mm and 1 mm.

21. Method according to claim 1, wherein said radial elements have a thickness e of between 0.2 mm and 1 mm.

22. Method according to claim 1, wherein said radial recesses have a radial depth p of between 0.1 D and up to 0.8 D.

23. Method according to claim 1, wherein said plurality of radial elements includes a plurality of N parallel transverse elements orientated perpendicular to said axial direction, with N being between 6 and 35.

24. Method according to claim 1, wherein said radial elements have a cross-section in a transverse plane perpendicular to said axial direction selected from among: a circular, oval, and polygonal, cross-section, a polygonal cross-section with rounded angles, and a symmetrical cross-section, relative to said axial direction.

25. Method according to claim 1, wherein said radial elements are integral with a central core, said radial elements including a streamlined peripheral part and an intermediate part having a constant thickness e.

26. Method according to claim 1, wherein said machined component includes, apart from said application means, an element of the second assembly means, so as to be able to couple said machined component to said axial rod.

27. Method according to claim 26, wherein said machined component includes an axial part forming a male element of said second assembly means, said male element being intended to engage with a blind hole formed at the lower part of said axial rod, said blind hole forming a female element of said second assembly means, said male and female elements being assembled by being snapped on axially or bonded or welded with ultrasounds, or by being forced fitted.

28. Method according to claim 26, wherein said machined component includes an axial cavity forming a female element of said second assembly means, said female element being intended to engage with an axial projection formed at said lower part of said axial rod, said axial projection forming said male element.

29. Method according to claim 1, wherein said machined component is a machined component including, apart from said application means, said axial rod.

30. Method according to claim 1, wherein said machined component forms a long machined component including a plurality of n elementary machined components, with n being between 2 and 20, said elementary machined components, after cutting said long machined product, forming said machined components.

31. Method according to claim 1, wherein:

a) said preform is first formed continuously, said preform being stored in the form of a coil or a roll of a long product, b) said preform is machined, on a pick-up basis, said machining device being supplied upstream with said coil or said roll.

32. Method according to claim 1, wherein said preform is formed and said machining device is supplied with said preform so formed, said preform supplying said machining device either continuously or step by step.

33. Method according to claim 1, wherein said preform and/or said machined component are subject to a surface treatment.

34. A method according to claim 1, wherein said machining device includes a means for the relative displacement of at least one machining tool, relative to said portion, said tool having a relative position marked by a system of coordinates, with an axial marker Z, a radial marker ρ and an angular marker θ, in such a way that, since said displacement means of said tool is computer-controlled, said tool is displaced and activated, according to a pre-established program, to form said radial recesses.

* * * * *